US005642959A

United States Patent [19]

Greferath

[11] Patent Number: 5,642,959

[45] Date of Patent: Jul. 1, 1997

[54] SUPPORT DEVICE FOR A SUBSTANTIALLY PANEL-LIKE COMPONENT

[75] Inventor: Hans-Gerd Greferath, Bad Salzuflen, Germany

[73] Assignee: Temotrans, B.V., Purmerend, Netherlands

[21] Appl. No.: 520,682

[22] Filed: Aug. 29, 1995

[30] Foreign Application Priority Data

Aug. 29, 1994 [DE] Germany ..... 9413972 U

[51] Int. Cl.[6] ..... A47K 3/22; E06B 3/02; E06B 3/54; E05D 15/06

[52] U.S. Cl. ..... 403/388; 403/293; 403/295; 4/596; 4/614; 52/285.2; 52/456; 52/204.62

[58] Field of Search ..... 403/293, 295, 403/292, 296, 388; 52/272, 285.2, 582.1, 204.62, 204.591, 314, 456; 4/596, 612, 614

[56] References Cited

U.S. PATENT DOCUMENTS

| | | | |
|---|---|---|---|
| 924,703 | 6/1909 | Streed | 52/285.2 |
| 2,083,409 | 6/1937 | Stevens | 52/456 |
| 5,425,208 | 6/1995 | Eekhout | 403/293 X |

FOREIGN PATENT DOCUMENTS

| | | | |
|---|---|---|---|
| 386276 | 9/1990 | European Pat. Off. | 4/614 |
| 0581140 | 2/1994 | European Pat. Off. . | |
| 3429053 | 2/1986 | Germany | 4/596 |

*Primary Examiner*—Anthony Knight

*Attorney, Agent, or Firm*—Pretty, Schroeder & Poplawski

[57] ABSTRACT

A bearing element for a substantially panel-like component having a support rail adjustably arranged thereon. The support rail may be connected to another bearing element of another component. The bearing element includes a recess in which the support rail is received at least in part. The bearing element includes a base member fastened by means of a pressure element to the component. The support rail may have a straight or angular shape and may include a hinge or joint in its central portion.

20 Claims, 8 Drawing Sheets

SUPPORT DEVICE FOR A SUBSTANTIALLY PANEL-LIKE COMPONENT

The present invention relates to a bearing element for a substantially panel-like component, for instance for a partition wall.

BACKGROUND OF THE INVENTION

It is known from the prior art that partitionings are formed by substantially panel-like components which are interconnected in a suitable manner. Such partitionings or room dividers are, for instance, used for shower partitions.

Since the panel-like components are relatively large panels, the bearing elements must exhibit sufficient stability for transmitting great forces, too. Furthermore, they must be designed such that they can be mounted and dismounted easily and permit adaptation to measuring (inaccuracies, etc.

EP-A1 581 140 already discloses a clamping element for panel material, especially glass panels. The clamping element comprises a spacer sleeve and an inner sleeve which are provided with two grooves arranged in parallel with each other, in which a pair of connection rods can be inserted. This design has been found to be disadvantageous insofar as the assembly of the bearing element requires a great deal of skill and adroitness, since a plurality of constructional elements have to be interconnected. Furthermore, the torsional stiffness of the whole bearing element is very small, since the inner sleeve and the spacer sleeve of adjacent bearing elements can be rotated in unimpeded fashion relative to one another, and it is only the pair of connection rods that connect relative to each other. Hence, this prior-art clamping element is suited neither for a rapid and safe assembly of large panel-like components nor for the transmission of major forces.

SUMMARY OF THE INVENTION

It is the object of the present invention to provide a bearing element of the above-mentioned type which, being of a simple construction and easily manufacturable at low costs, can be mounted easily and shows a high degree of stability during transmission of great forces and which additionally meets the highest optical demands.

In accordance with the invention, this object is achieved by at least one bearing element which is fastened to the component and which has arranged thereon a support rail which is connected to another bearing element of another component.

The bearing element of the invention is characterized by a number of considerable advantages. Since adjacent bearing elements are connected in accordance with the invention by a support rail, it is possible to transmit great forces in a reliable manner. The support rail may have any desired cross-section, an especially advantageous cross-section of the support rail is however a rectangular one.

Thanks to the insertable arrangement of the support rail, the bearing element can clamp and hold the rail in an especially efficient manner. Thus the bearing element itself need only be of a small size, based on the dimensions of the support rail.

In a preferred development of the invention, the bearing element comprises a recess in which the support rail is received at least in part. Apart from an advantageous introduction of forces, an optimum optical appearance is obtained for such a design. This is especially of importance whenever the bearing element is used as a visible constructional member and is to serve decoration purposes at the same time.

In accordance with the invention, the recess for receiving the support rail is preferably formed at least in part in a base member. This creates the possibility of covering and holding the remaining cross-sectional portion of the support rail by another component.

To secure the bearing element to the panel-shaped component in such a manner that the component demands as little working as possible, it is advantageous when the base member is fastened by means of a pressure element to the component. The base member and/or the pressure element preferably extend through a recess. If the panel-like component is designed as a panel of a single-pane safety glass, very simple holes are sufficient for passing the base member and/or the pressure element therethrough. Troublesome and technically complicated working is not necessary.

The support rail is preferably fastened to the bearing element by means of a separate fastening element. The fastening element may be designed as an optically visible element, but it is also possible to additionally cover the fastening element with a cap, so that it will no longer be visible when the mounting of the construction has been finished. For instance, it is possible to provide a recess in the form of an elongated hole or the like in the support rail to clamp the support rail to the base member by means of a screw formed as a clamping element. The screw may then be covered with a cap or cover. Alternatively, it is also possible to design the clamping element such that it is the clamping element itself which forms a fastening screw which can be screwed to the base member to fasten the support rail. In such a case, the clamping element preferably comprises a recess in which the support rail is received at least in part.

The support rail is advantageously formed such that it can be held on two bearing elements which are fastened to adjacent components. To this end, the support rail may be given either a straight shape or an angular shape. However, it is also possible to provide a hinge or joint in the central portion of the support rail, so that the support rail permits the opening or closing of one of the components. Hence, the bearing element of the invention is suited either for interconnecting rigid components or for supporting a door on a stationary component. Such a universal design permits the most varied applications. Furthermore, it is possible by bending or folding the support rail to implement virtually any desired ground plan shapes.

In an alternative embodiment, the support rail may be designed such that its free end is shaped for any desired fastening to another constructional element. The support rail can thus be screwed directly to the wall of a building. Furthermore, it is possible to support running wheels or rollers on the support rail to move the panel-like component either on the ground or along running rails.

BRIEF DESCRIPTION OF THE DRAWING

The invention shall now be explained with reference to embodiments taken in conjunction with the drawings, in which.

DETAILED DESCRIPTION OF THE PREFERRED EMBODIMENT

Figure 1:
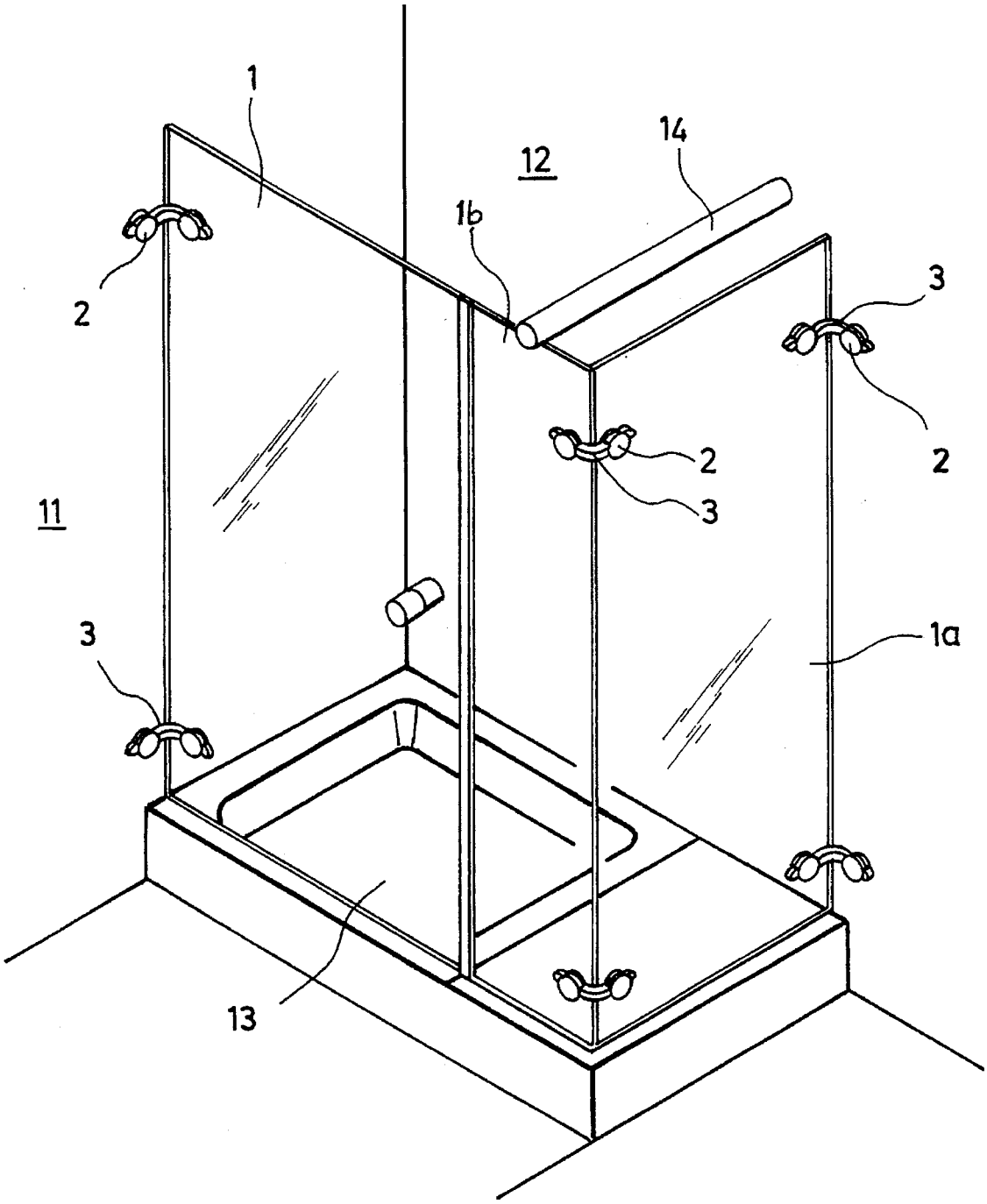
FIG. 1 is a diagrammatic perspective view of a shower partition using bearing elements according to the invention.

FIG. 1 is a diagrammatic perspective view of the design of a shower partition using the bearing elements according to the invention.

A shower pan 13 is mounted in an angle of two walls 11 and 12 that are at right angles to each other. The interior of the shower cabinet which is defined by the size of the shower pan 13 is surrounded by a panel-like component 1 which is shaped like a door. Next to the door, there is arranged a stationary component 1*b* which is fixed via a holding rod 14. Next to component 1*b*, there is mounted another component 1*a* which forms the lateral wall. The components are each manufactured as single-pane safety glass.

As shown in FIG. 1, respective bearing elements 2 are provided and interconnected by a respective support rail 3. To fasten components 1*a* and 1*b* to wall 12 and to each other, respectively, the support rails 3 are each given an angled shape. The door is also fastened by an angled support rail 3 which is additionally provided with a hinge.

Figure 2:
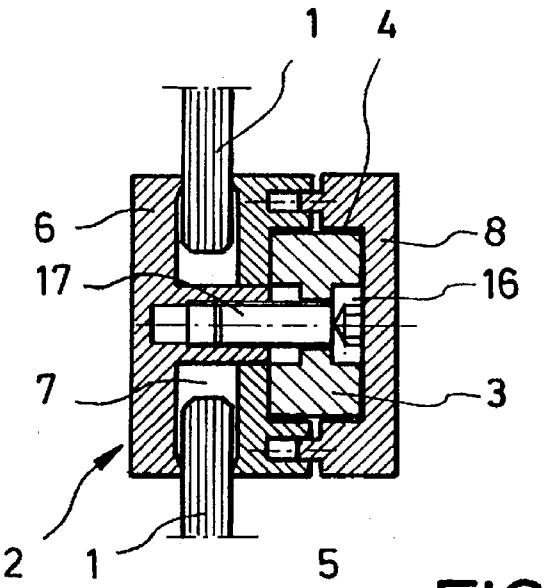
FIG. 2 is a sectional view through a bearing element according to the invention.
Figure 3:
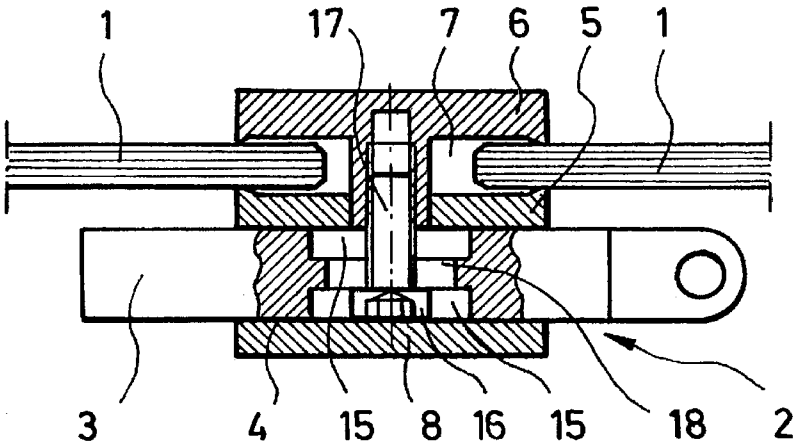
FIG. 3 is a sectional view of the assembly shown in FIG. 2, offset by 90°.
Figure 4:
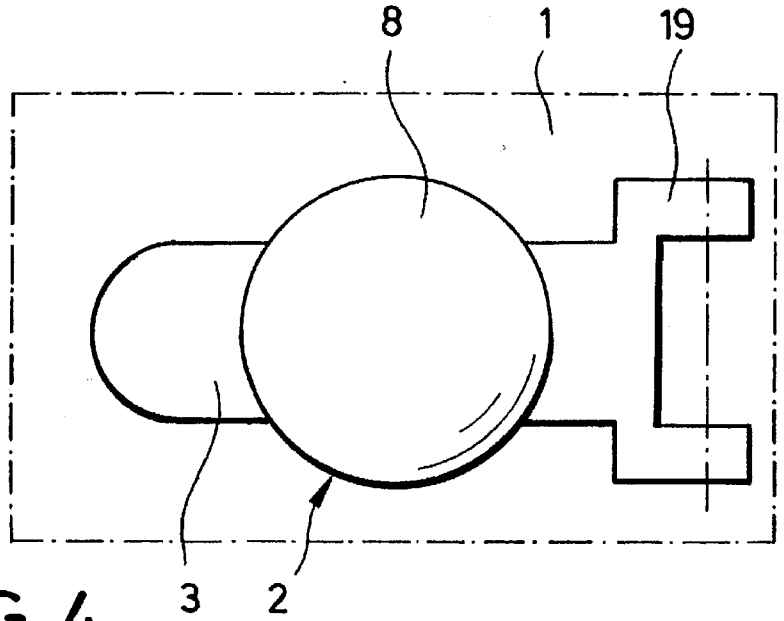
FIG. 4 is a lateral view of the assembly illustrated in FIGS. 2 and 3, the bearing element forming part of a hinge element.

FIGS. 2 to 4 show the design of the bearing element of the invention in detail.

First of all, the bearing element comprises a base member 5 which can be fastened to a pressure element 6. Base member 5 and/or pressure element 6 extend at least in part through a recess of component 1. Recess 7 is, for instance, designed as a bore. FIGS. 2 to 4 show further that the support rail 3 has a substantially rectangular cross-section and is arranged at least in part in a recess 4 of the bearing element 2 and of base member 5, respectively.

In the illustrated embodiment, support rail 3 is provided at both sides with grooves 15 shaped in the form of elongated holes, which are dimensioned such that head 16 of a screw 17 can be received entirely in groove 15. The support rail has a symmetrical structure relative to grooves 15. The two grooves are interconnected by a recess 18.

As shown in FIGS. 2 and 3, screw 17 serves both to fasten base member 5 and pressure element 6 and to clamp support rail 3.

As becomes especially apparent from FIG. 2, a clamping element 8 which is designed as a cover serves to mask screw 17. However, it is also possible to make the head of screw 17 integral with the clamping element 8 or to fasten the clamping element 8 additionally by means of the screw, with head 16 of screw 17 being then arranged in a recess of the clamping element 8 and being possibly covered in addition.

FIGS. 3 and 4 show that the free end of the support rail 3 is designed as a U-shaped fork 19 which forms part of a hinge that will be described in the following by way of example in conjunction with FIGS. 9 to 12.

Figure 6:
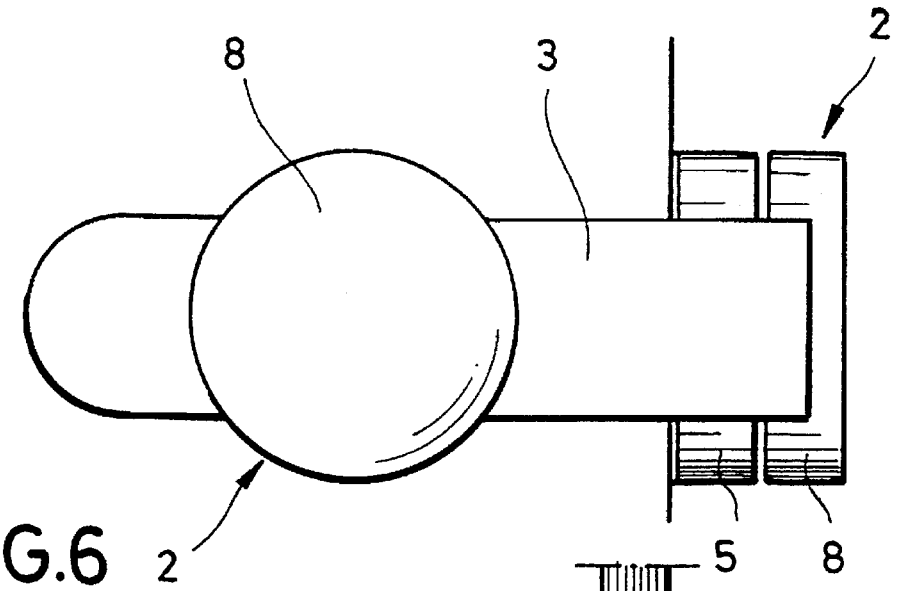
FIG. 6 is a lateral view of the assembly according to FIG. 5.
Figure 5:
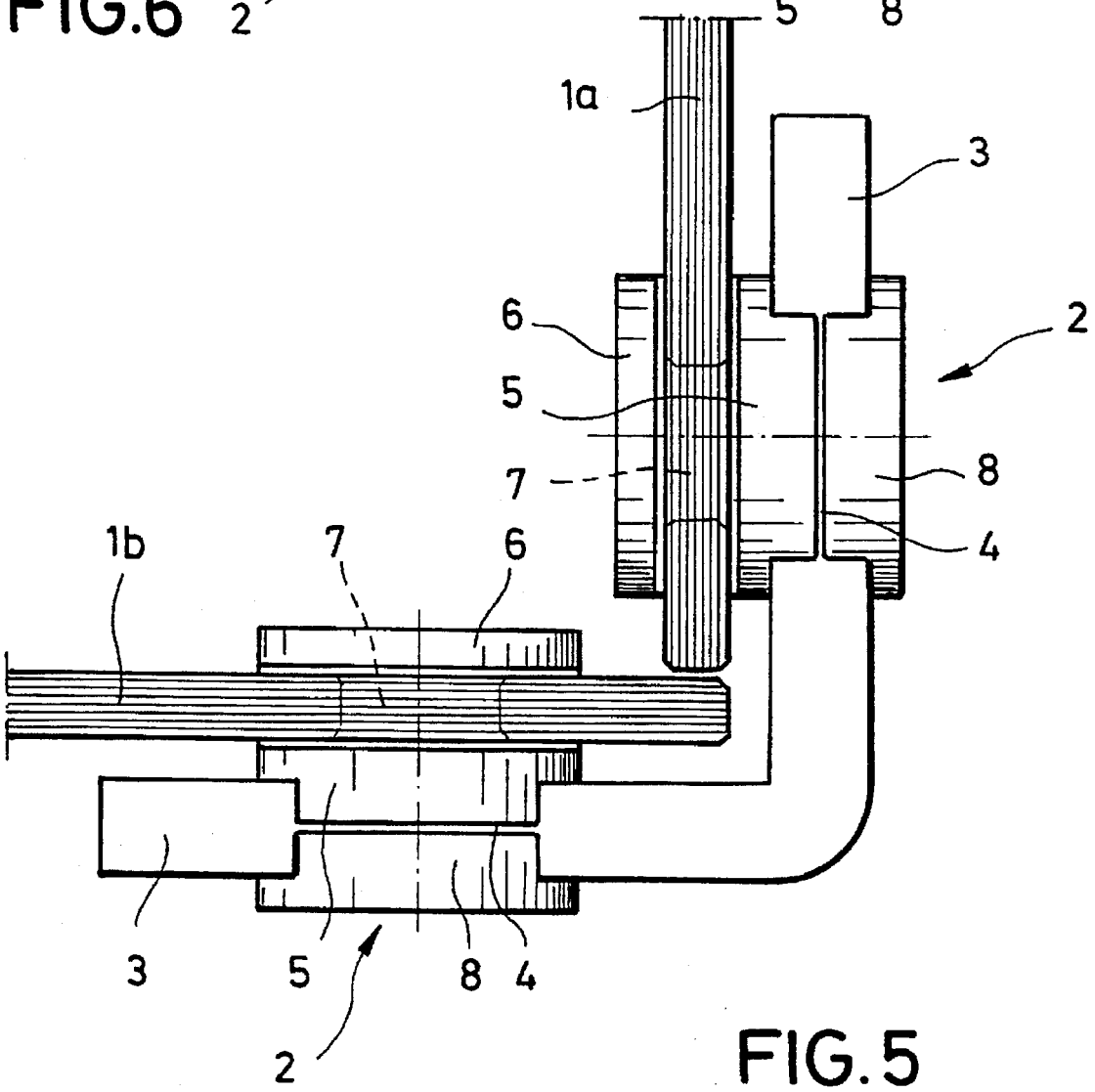
FIG. 5 is a sectional view, top view, of another embodiment of the bearing element and the support rail, respectively, of the invention.

FIGS. 5 and 6 illustrate a variant in which the support rail 3 is angled in its central portion by 90°, so that adjacent components 1*a* and 1*b* can be mounted to abut on each other laterally.

Figure 8:
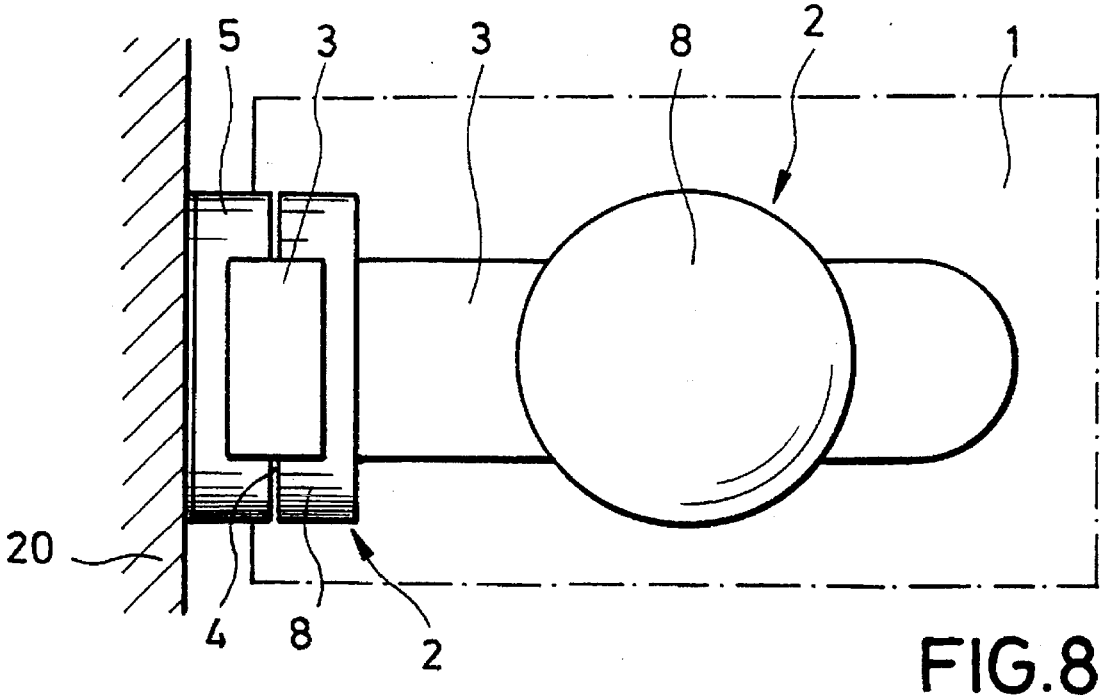
FIG. 8 is a lateral view of the assembly shown in FIG. 7.
Figure 7:
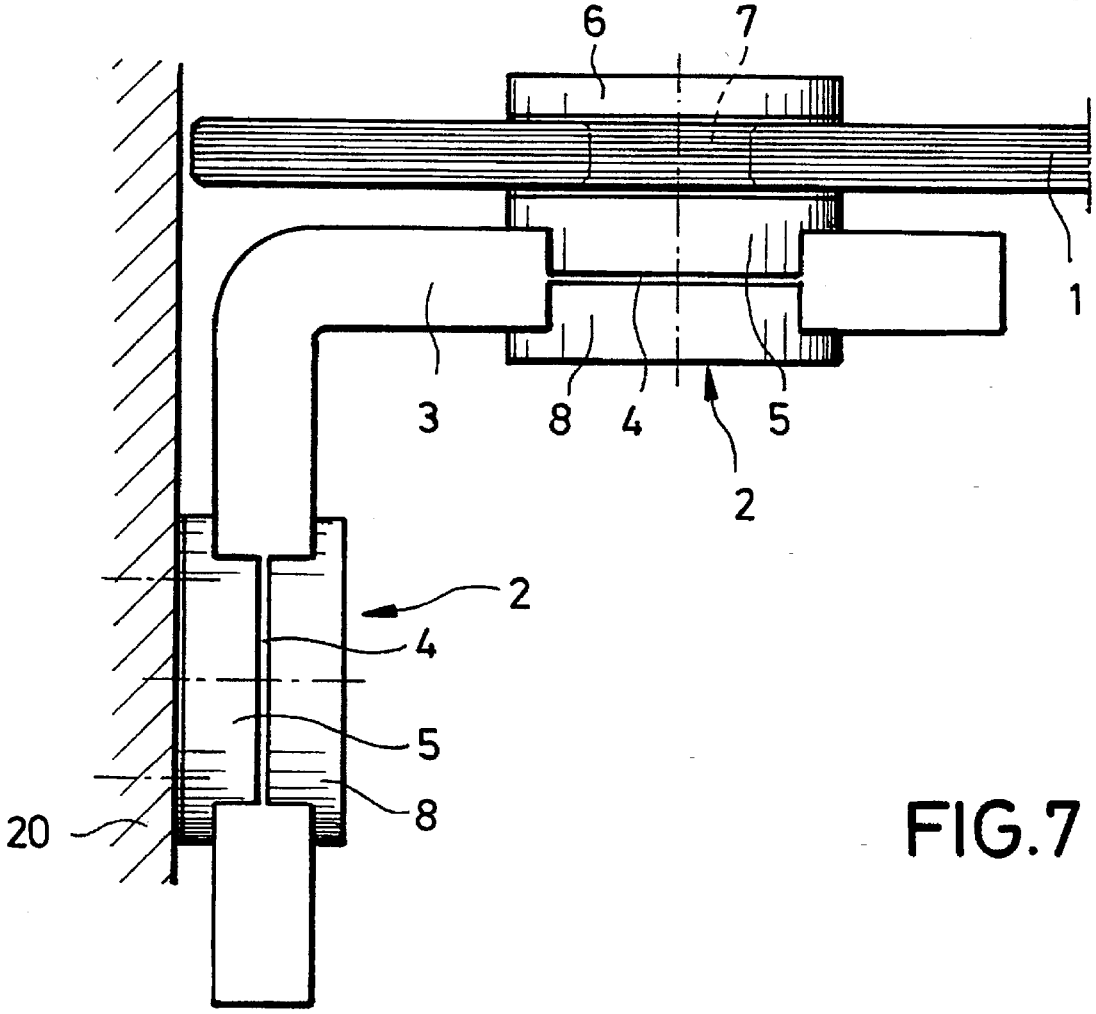
FIG. 7 is a sectional view, top view, of another variant of the bearing element and the associated support rail, respectively, of the invention.

FIGS. 7 and 8 illustrate another variant in which a bearing element 2 is connected to the panel-like component 1 whilst the other bearing element 2 is directly screwed to a wall 20. This variant is illustrated byway of example in FIG. 1 on the right half of the figure (fastening of component 1*a* to wall 12).

Figure 10:
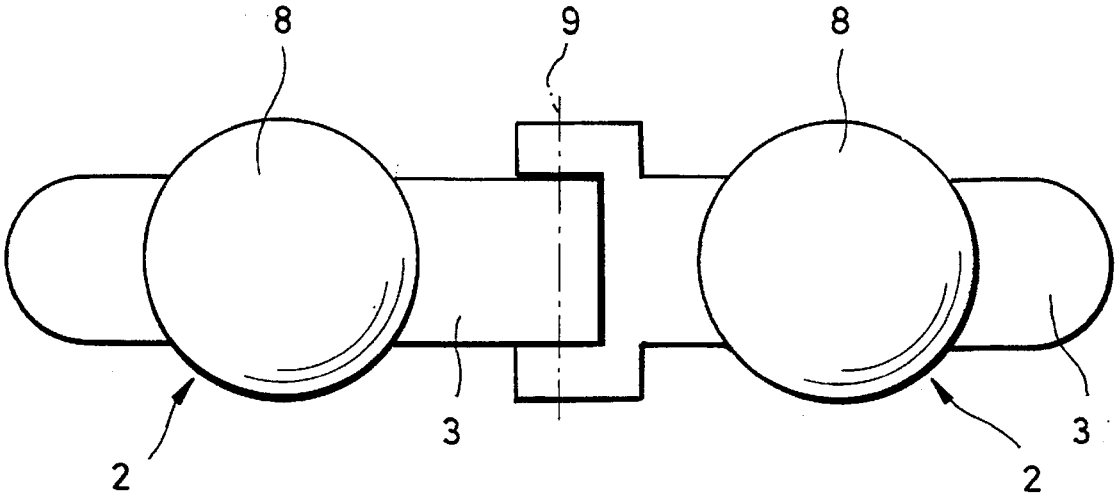
FIG. 10 is a lateral view of the assembly according to FIG. 9.
Figure 9:
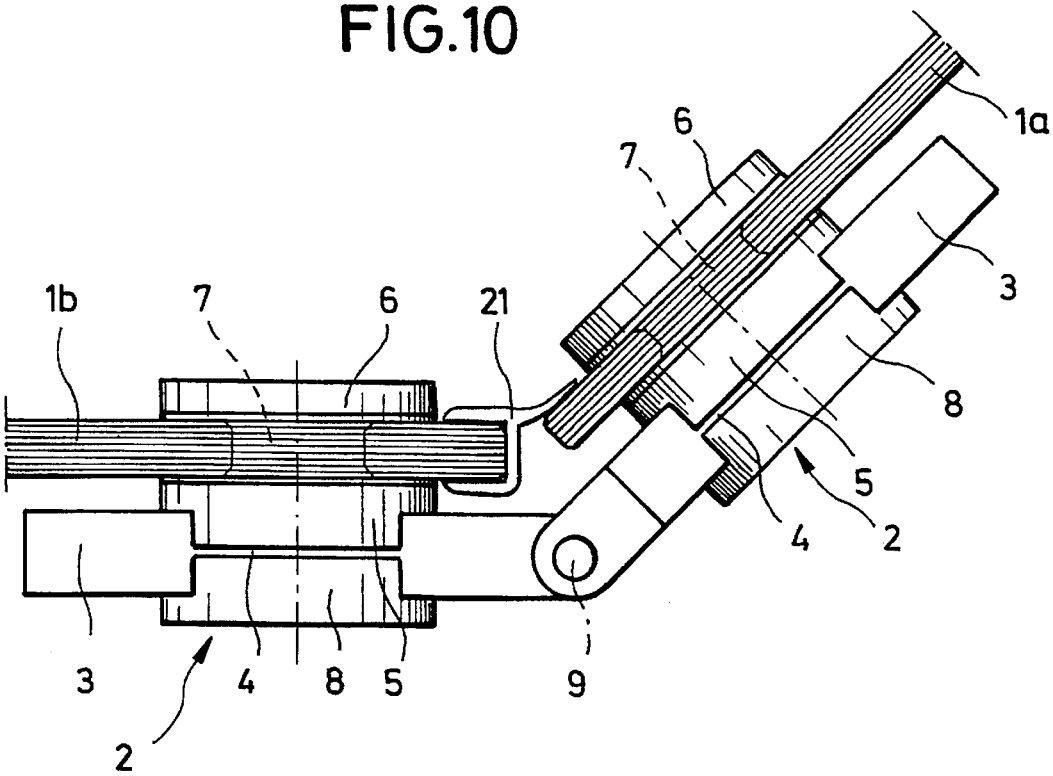
FIG. 9 is a partial sectional view, top view, of another design of the bearing assembly of the invention, in which the support rail is provided with a central joint and thus corresponds to the development according to FIGS. 3 and 4.

FIGS. 9 and 10 illustrate another variant in which a hinge 9 is provided in the central portion of support rail 3, so that the adjacent components 1*a* and 1*b* can be pivoted relative to each other. An additional sealing lip 21 serves sealing purposes.

Figure 12:
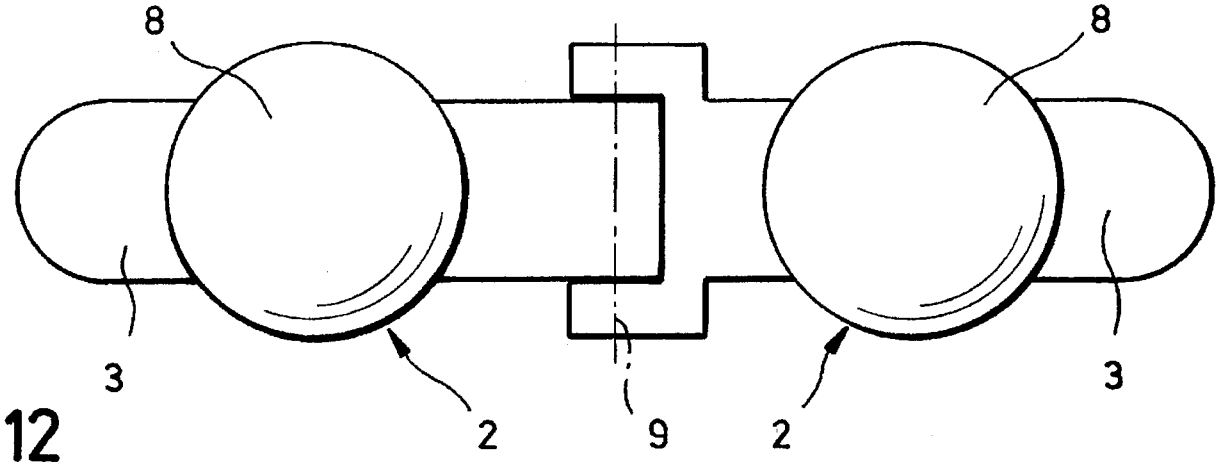
FIG. 12 is a lateral view of the assembly of FIG. 11.
Figure 11:
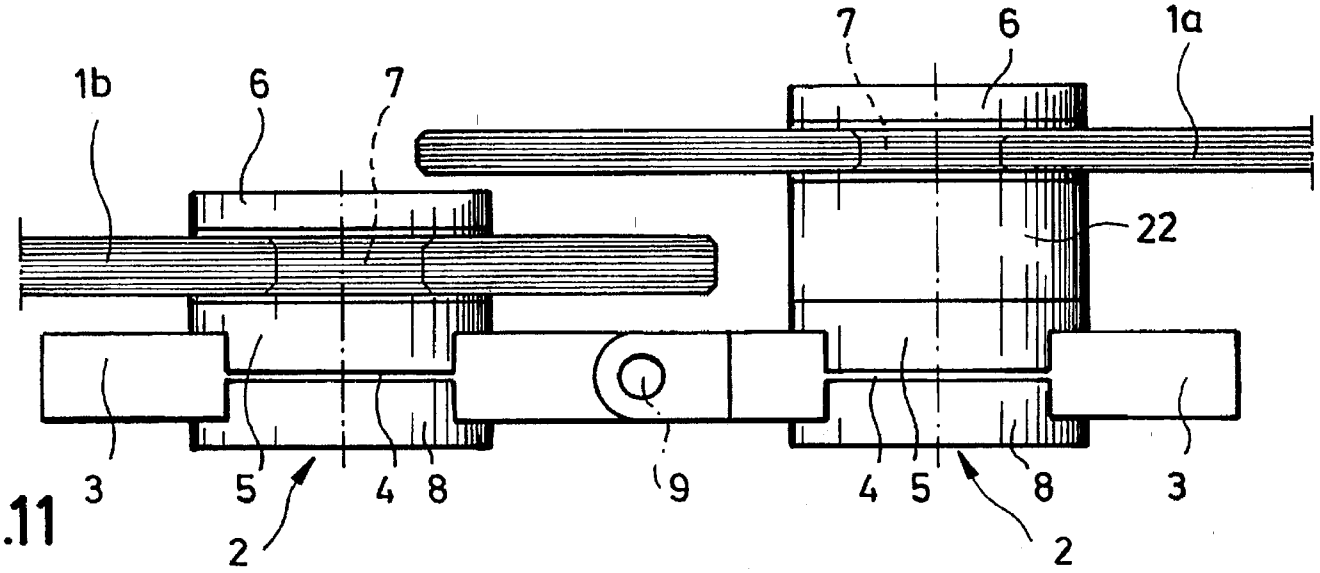
FIG. 11 is a partial sectional view, top view, of an embodiment modified with respect to FIG. 9.

Another variant of a hinge-like connection is shown in FIGS. 11 and 12. To arrange the components 1*a* and 1*b* in overlapping fashion relative to each other, a spacer 22 is inserted on the right bearing element 2 between base member 5 and pressure element 6. The spacer is held by the screw 17 shown in FIGS. 2 and 3.

Figure 14:
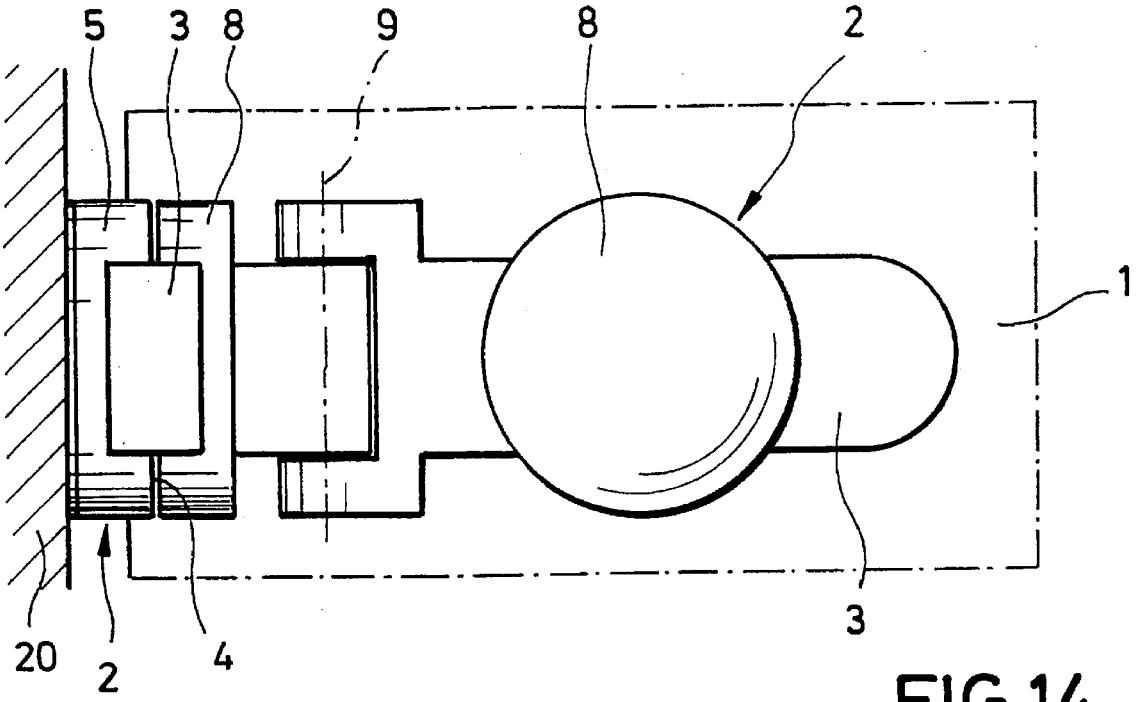
FIG. 14 is a lateral view of the assembly shown in FIG. 13.
Figure 13:
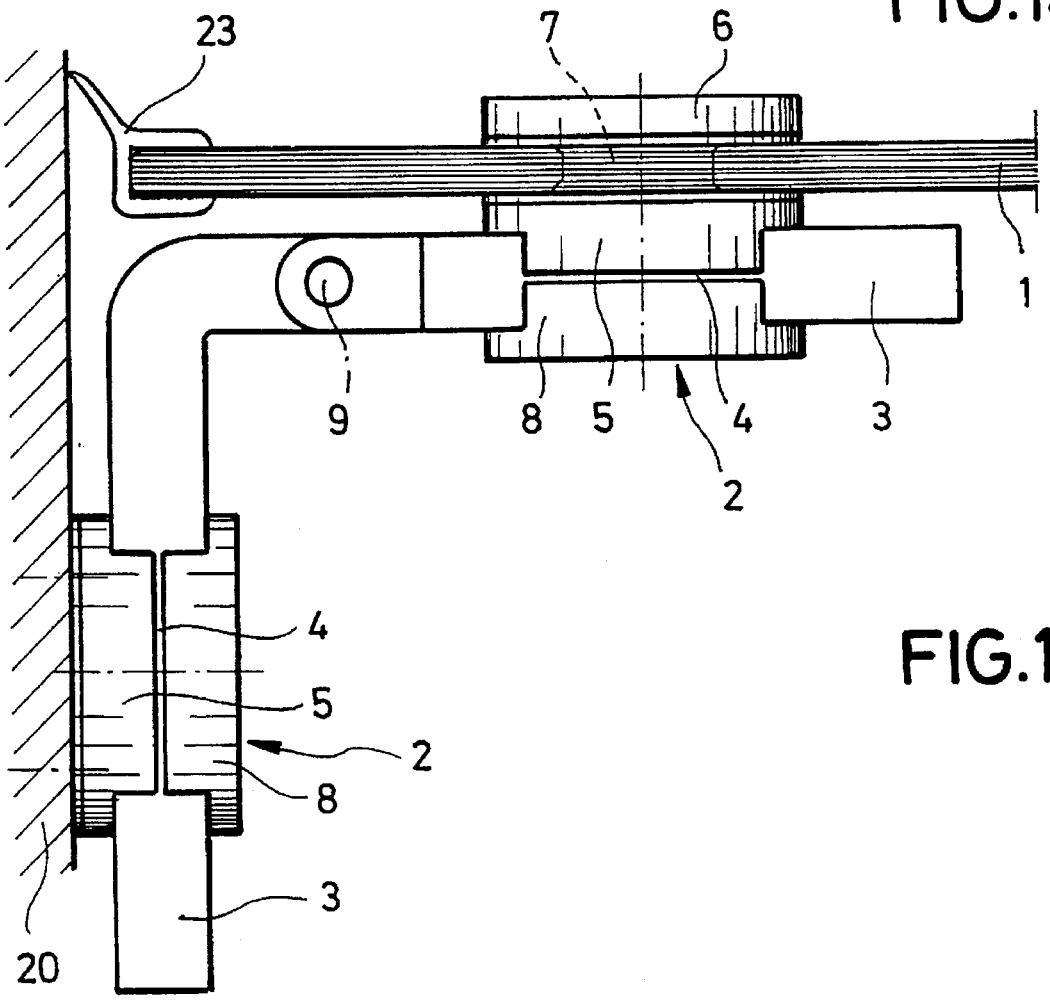
FIG. 13 is a top view on another variant of the bearing element of the invention, wherein the support rail is angled and provided with a hinge.

A modified hinge-like design is shown by FIGS. 13 and 14, with the hinge corresponding to the illustration in FIG. 1 (support of door 1 on wall 11). Like with the embodiment shown in FIGS. 7 and 8, a free end of the support rail 3 is directly screwed to a wall 20 of a building while the free end of the support rail 3 which is hingedly supported communicates via a bearing element 2 with component 1.

The free edge of component 1 (door) is sealed via a sealing lip 23.

Figure 15:
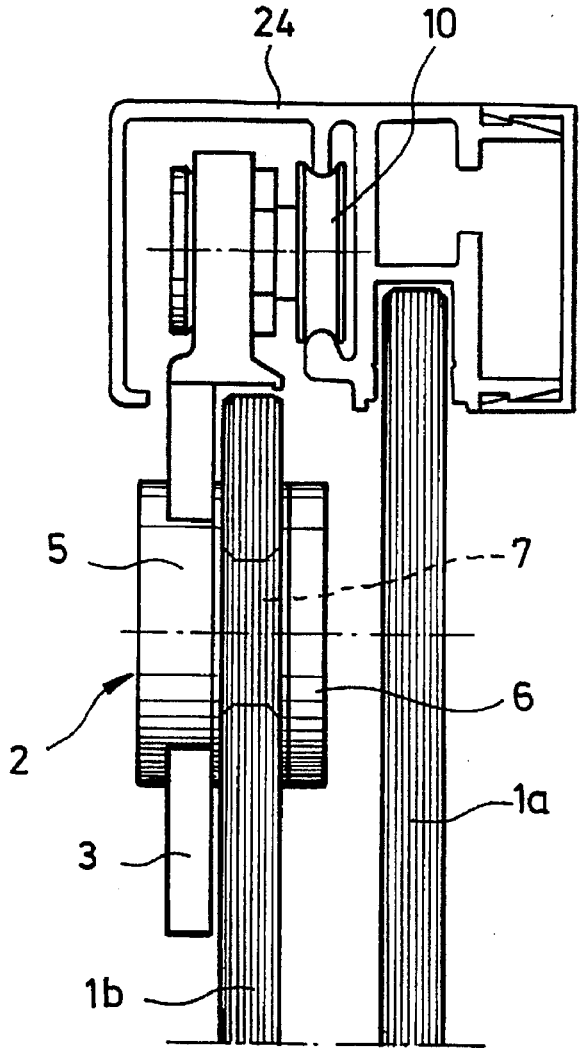
FIG. 15 is a vertical sectional view of a variant in which a roller is arranged at the free end of the support rail.
Figure 16:
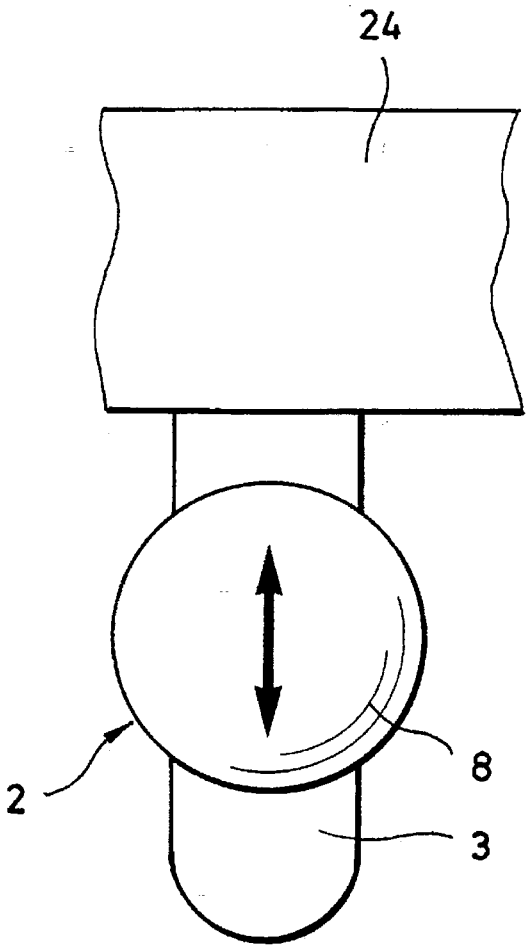
FIG. 16 is a lateral view of the assembly shown in FIG. 14.

FIGS. 15 and 16 show another variant in which the support rail 3 extends vertically and supports, on its free upper end, a roller 10 which is guided in a rail 24. Hence, it is also possible to realize sliding doors or overhung doors with the aid of the bearing element of the invention. It is also possible to form slidable panels, for instance for decoration purposes. The double-headed arrow in FIG. 16 shows the vertical adjustability of the construction which follows from the slidability of the support rail 3 relative to the bearing element 2.

The present invention is not limited to the illustrated embodiments; rather many variations and modifications are obvious to the person skilled in the art within the scope of the present invention.

To sum up, the following should be stated:

The present invention relates to a bearing element for a substantially panel-like component (1), characterized by at least one bearing element (2) which is fastened to component (1) and which has adjustably arranged thereon a support rail (3) which is connected to another bearing element (2) of another component (1) (FIG. 1).

I claim:

1. In combination with a panel-like component, a support device comprising:

a bearing element fastened to the component, the bearing element having a recess formed on a side opposite the component;

a support rail with opposing first and second sides, the first side or which is arranged within the recess in the bearing element, the support rail further having a bore therethrough; and, a fastener having a shank extending through the bore in the support rail and fastened to the bearing element, the fastener further having a head which is larger than the bore in the support rail and disposed on the second side of the support rail whereby when tightened the fastener will hold the support rail in fixed relation to the bearing element and the component.

2. The combination of claim 1, wherein the bearing element comprises a pressure element adjacent a bore in the component, and a base member adjacent the component on an opposite side of the component from the pressure element, the base member having the recess in which the support rail is arranged and further having an axial bore therethrough in communication with the bore in the component whereby the fastener extends through the base member and the component and is fastened to the pressure element.

3. The combination of claim 2, wherein the pressure element partially extends through the bore in the component.

4. The combination of claim 2, wherein the base member partially extends through the bore in the component.

5. The combination of claim 1, wherein the support rail is substantially rectangular in cross section.

6. The combination of claim 1, further comprising a cover which is fastened over the head of the fastener thereby masking the fastener from view.

7. The combination of claim 6, wherein the cover includes a recess in which the second side of the support rail is received in part.

8. The combination of claim 1, wherein each of the first and second sides of the support rail includes a groove partially therethrough and axial with the bore therein for receiving the head of the fastener.

9. The combination of claim 1, wherein the support rail has a free end for attachment to an adjacent panel-like component.

10. The combination of claim 9, wherein the support rail is straight.

11. The combination of claim 9, wherein the support rail is angular in shape.

12. The combination of claim 9, wherein the support rail is provided in its central portion with a hinge.

13. The combination of claim 1, wherein the support rail has a free end for attachment to a roller.

14. In combination with a panel-like component with a bore therethrough for receiving a support device, the support device comprising:

a bearing element which includes a pressure element disposed adjacent the bore in the component and a base member disposed adjacent the component on an opposite side of the component from the pressure element, the base member having an axial bore in communication with the bore in the component and a recess on a side opposite the component;

a support rail with opposing first and second sides, the first side of which is arranged within the recess in the base member, the support rail further having a bore therethrough in communication with the bore in the base member; and, a fastener having a shank extending through the bores in the support rail, the base member and the component, and attached to the pressure element, the fastener further having a head which is larger than the bore in the support rail and disposed on the second side of the support rail whereby when tightened the fastener will hold the pressure element, the base member, the support rail and the component all in fixed relation to each other.

15. The combination of claim 14, wherein the support rail is substantially rectangular in cross section.

16. The combination of claim 14, further comprising a cover which is fastened to the head of the fastener thereby masking the fastener from view.

17. The combination of claim 14, wherein each of the first and second sides of the support rail includes a groove partially therethrough and axial with the bore therein for receiving the head of the fastener.

18. The combination of claim 14, wherein the support rail has a free end which is attached to an adjacent panel-like component.

19. The combination of claim 18, wherein the support rail includes a hinge in its central portion.

20. The combination of claim 14, wherein the support rail has a free end for attachment to a roller.

* * * * *